United States Patent [19]

Pessier

[11] 4,089,382

[45] May 16, 1978

[54] CUTTER MOUNTING FOR A LARGE HOLE EARTH BORING BIT

[75] Inventor: Rudolf Carl Otto Pessier, Houston, Tex.

[73] Assignee: Hughes Tool Company, Houston, Tex.

[21] Appl. No.: 784,019

[22] Filed: Apr. 4, 1977

[51] Int. Cl.[2] ..... E21B 9/08

[52] U.S. Cl. ..... 175/361; 175/374; 403/409

[58] Field of Search ..... 175/361–364, 175/374, 347, 372; 403/161, 162, 374, 409, 297; 308/237, 8.2, 15

[56] References Cited

U.S. PATENT DOCUMENTS

| | | | |
|---|---|---|---|
| 374,833 | 12/1887 | Hill | 308/237 R |
| 741,563 | 10/1903 | Stevens et al. | 85/79 |
| 2,177,138 | 10/1939 | Hollander | 85/79 |
| 2,542,424 | 2/1951 | Mulder | 403/409 X |
| 3,705,750 | 12/1972 | Crow | 175/364 X |
| 3,747,999 | 7/1973 | Justman | 175/364 X |
| 3,750,772 | 8/1973 | Venter | 175/347 X |

*Primary Examiner*—Ernest R. Purser
*Assistant Examiner*—Richard E. Favreau
*Attorney, Agent, or Firm*—Robert A. Felsman

[57] ABSTRACT

A large hole earth boring bit with a clevis-type coupling for mounting the rolling cutters to the bit. The mounting apparatus includes a first member having two ends with aligned holes and a second member having its end inserted between the two ends. The end of the second member has an aperture that is spaced slightly out of alignment with the apertures in the first member, providing a generally elliptical passage. Bearing surfaces prevent them from coming into alignment. A pair of wedges are inserted into the elliptical passage and drawn together to exert a force in the direction toward alignment of the apertures. The force exerted is transmitted into the base, positively locking the two members together.

6 Claims, 8 Drawing Figures

CUTTER MOUNTING FOR A LARGE HOLE EARTH BORING BIT

BACKGROUND OF THE INVENTION

1. Field of the Invention

This invention relates in general to earth boring drill bits, and in particular to a cutter mounting for a large hole earth boring drill bit.

2. Description of the Prior Art

One phase of the earth boring industry is concerned with drilling large diameter holes for mining. Normally several cutters are mounted on frames which are mounted to a large cutter support plate. The cutter support plate is connected to a drill string and rotated with each cutter rotating on its individual frame. Drilling is performed by pulling upward through a small diameter pilot hole, or by blind shaft drilling without using the pilot hole.

The cutters are carried by bearings and mounted to individual frames that are welded to the cutter support plate. Various devices including pins and bolts are used to mount the bearing carrier to the frame. Bolts require high torques and still occasionally become unscrewed because of the high vibratory forces. If a pin is used in a clevis-type arrangement, the two holes of the frame must be aligned with the hole in the bearing carrier within very small tolerances to minimize any play between them. This type of clevis is expensive to construct and a certain amount of play always remains.

SUMMARY OF THE INVENTION

It is accordingly a general object of this invention to provide an improved cutter mounting for an earth boring drill bit.

It is a further object of this invention to provide an improved clevis-type coupling for mounting a cutter to an earth boring drill bit that prevents any play and does not require fine tolerance machining.

It is a further object of this invention to provide an improved clevis-type cutter mounting device for an earth boring drill bit that allows the cutters to be easily assembled and removed from the frame without requiring high torque bolts.

In accordance with these objects, a clevis-type coupling is provided for connecting the bearing carrier of a cutter to a cutter frame wherein the holes in the U-shaped member are spaced out of alignment with the hole in the center member. The U-shaped member has a bearing surface between the two ends which the center member bears against to prevent the holes from being pulled into alignment. A pair of wedge members with mating tapered surfaces are inserted into the generally elliptical passage provided by the nonaligned circular holes. The wedge members are drawn together by a bolt, wedging the center member tightly to the U-shaped member, preventing any play.

DESCRIPTION OF THE PREFERRED EMBODIMENT

Figure 1:
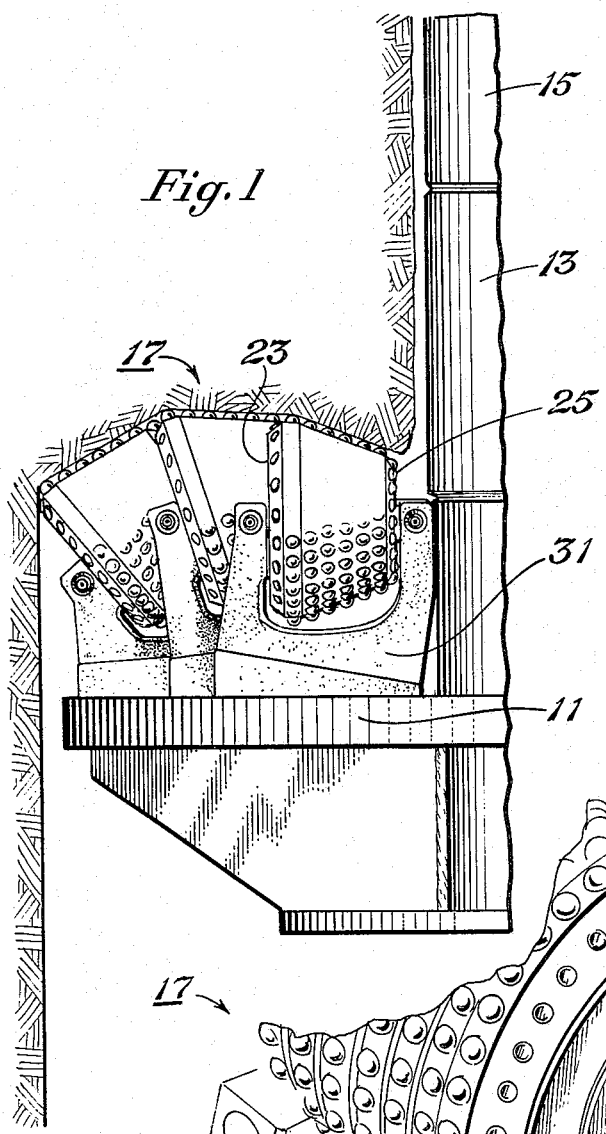
FIG. 1 is a partial side elevational view of an earth boring bit constructed in accordance with this invention.

FIG. 1 illustrates a large diameter earth boring bit being pulled upward through a pilot hole. The major parts of the earth boring bit shown consist of a cutter supporting plate or cutter support 11, a drill stem section or sub 13 mounted to the center of the cutter support 11 and connected to the drill string 15, and a plurality of cutter assemblies 17 mounted to the upper surface of the cutter support 11.

Figure 2:
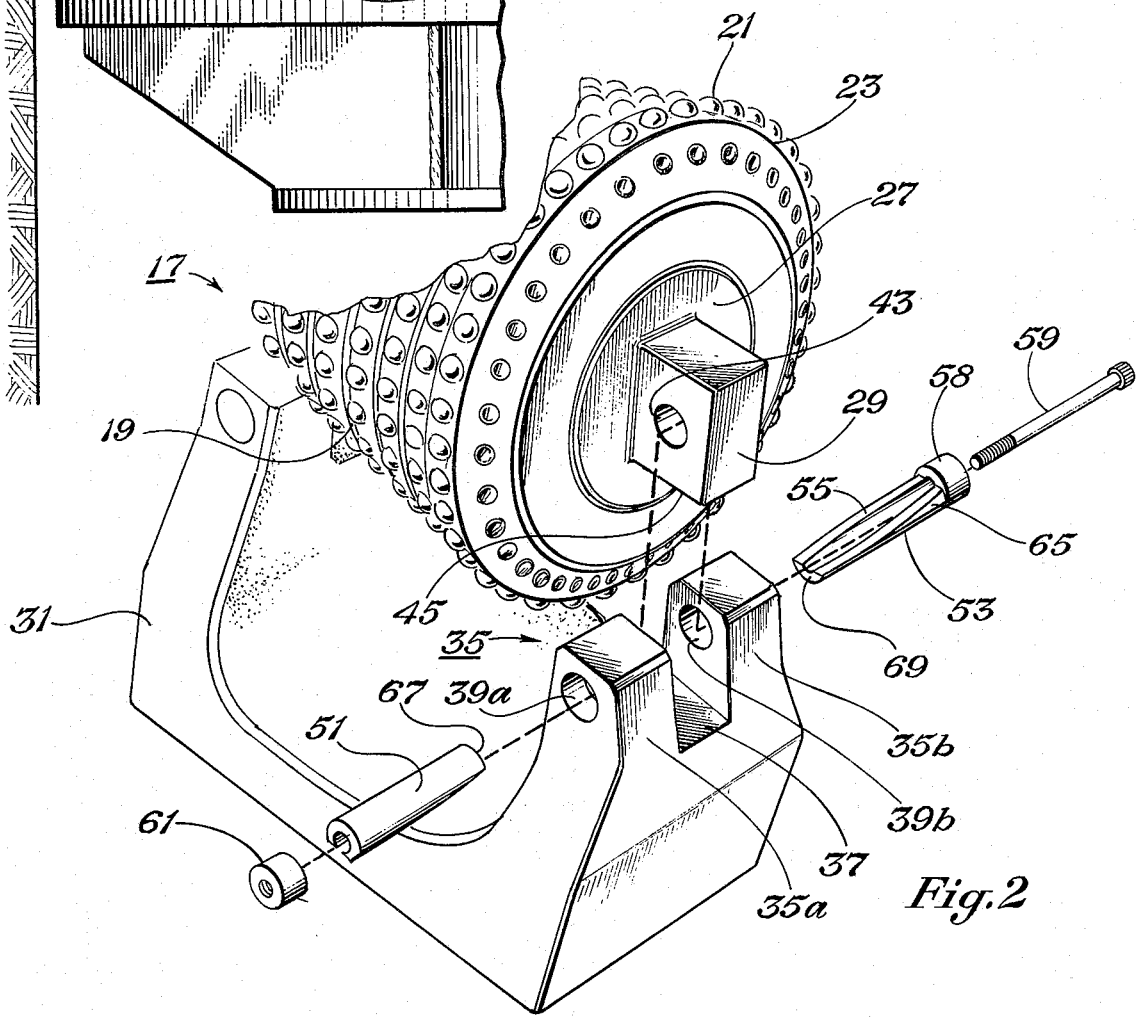
FIG. 2 is an exploded partial perspective view of one of the cutter assemblies of FIG. 1.

As shown in FIG. 2, the cutter assembly 17 includes a cutter shell 19 with earth disintegrating teeth 21 spaced in rows. The cutter shell 19 is in the configuration of a truncated cone with the larger end or base 23 farther outward radially from the stem 13 than the smaller end 25, as shown in FIG. 1. The cutter shell is carried by bearings (not shown) on a load pin, axle, or bearing carrier 27. The bearing carrier 27 is an irregularly shaped member that extends through the cutter shell 19 and has pin blocks 29 formed on each end for connection to a cutter mount or frame 31. Frame 31 is welded to cutter support 11.

Figure 3:
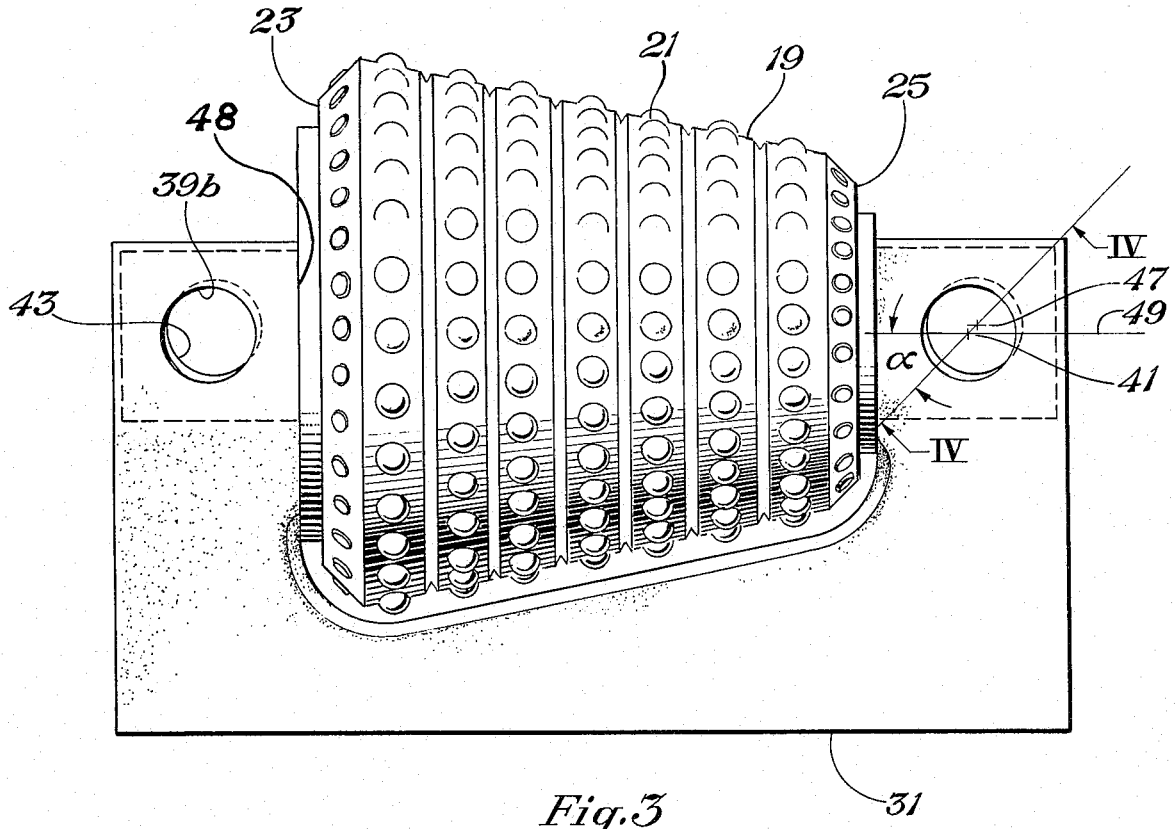
FIG. 3 is a side elevational view of one of the cutter assemblies of FIG. 1, with the wedge members removed.

Pin block 29 is adapted to fit closely into a U-shaped member or clevis 35 formed on the end of frame 31. Clevis 35 has two upstanding ends **35*a* and 35*b*, similar in size to pin block 29, with a portion of the frame designated as bearing surface 37 between them. Each clevis end 35*a,b* has a circular aperture 39*a,b* extending through perpendicular to the bearing carrier 27 axis 49 (FIG. 3). The centerlines of aperture 39*a,b* coincide, as indicated at 41 in FIG. 3. Pin block 29 also contains an aperture 43 of equal size to apertures 39*a,b*. Aperture 43 is spaced from the lower surface 45 of pin block 29 a slightly greater distance than the distance from apertures 39*a,b* to bearing surface 37. Since lower surface 45 bears against bearing surface 37, this places the centerline 47 of aperture 43 slightly farther from bearing surface 37 than the centerline 41 when lower surface 45 contacts bearing surface 37**, as shown in FIG. 3.

The drilling forces are directed generally toward the larger end 23 of the cutter. To prevent any play in this direction, the centerlines 41, 47 are also nonaligned generally in the direction of the drilling force. The bearing carrier 27 is preloaded against the inner face 48 of the side of the frame 31 that receives the larger end 23 of the cutter. The centerline 41 of apertures **39*a,b* on the smaller end 25 is located closer to inner face 48, or farther from drill stem 13 than centerline 47. Centerline 41 of apertures 39*a,b* on the larger end 23 is located farther from the inner face 48, or farther from the drill stem 13 than centerline 47. Centerline 41 preferably intersects a line extending from centerline 47 at a negative angle $\alpha$ in the range from 15° to 55°, preferably 45° with respect to axis 49 of the bearing carrier 27. Inner face 48 thus serves along with bearing surface 37 for maintaining aperture 43 in the desired nonalignment with apertures 39***a,b*. As shown in FIG. 3, the nonaligned apertures define a noninterrupted passage that is noncircular or generally elliptical. The height of the noninterrupted opening is smaller than its width, which is the width of the apertures 39*a,b* and 43. Preferably the centerlines 41, 47 are spaced apart in the range from 0.030 inches to 0.060 inches.

Figure 4:
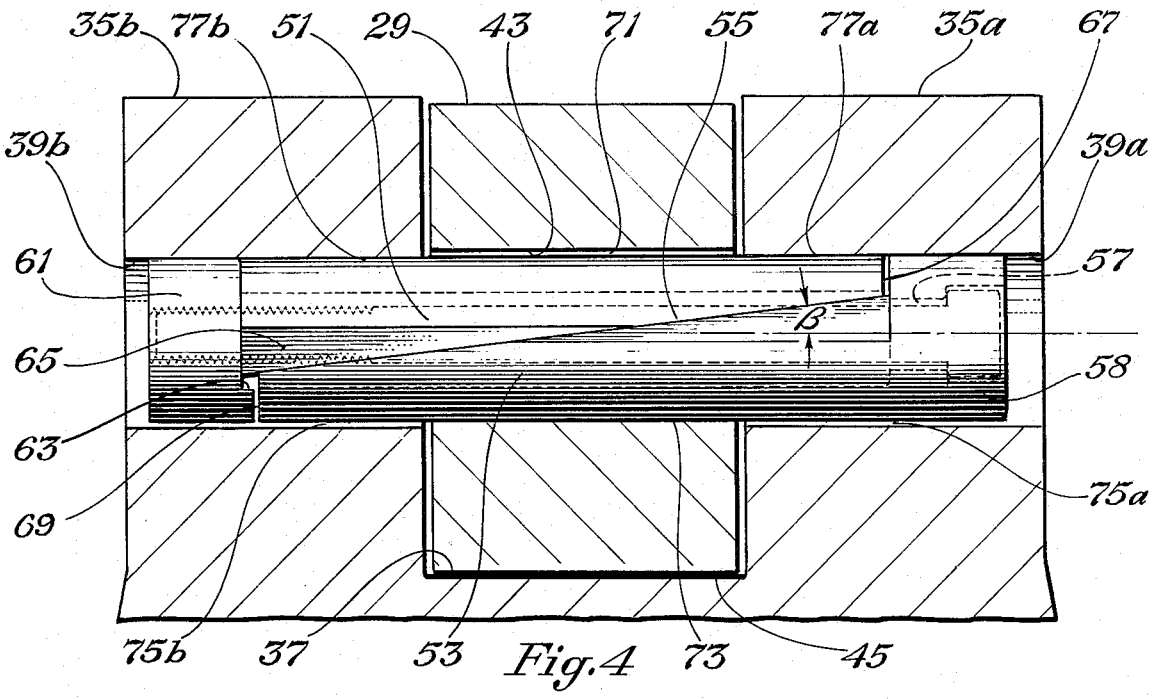
FIG. 4 is a cross-sectional view of a portion of the cutter assembly of FIG. 3 taken along the lines IV—IV.
Figure 5:
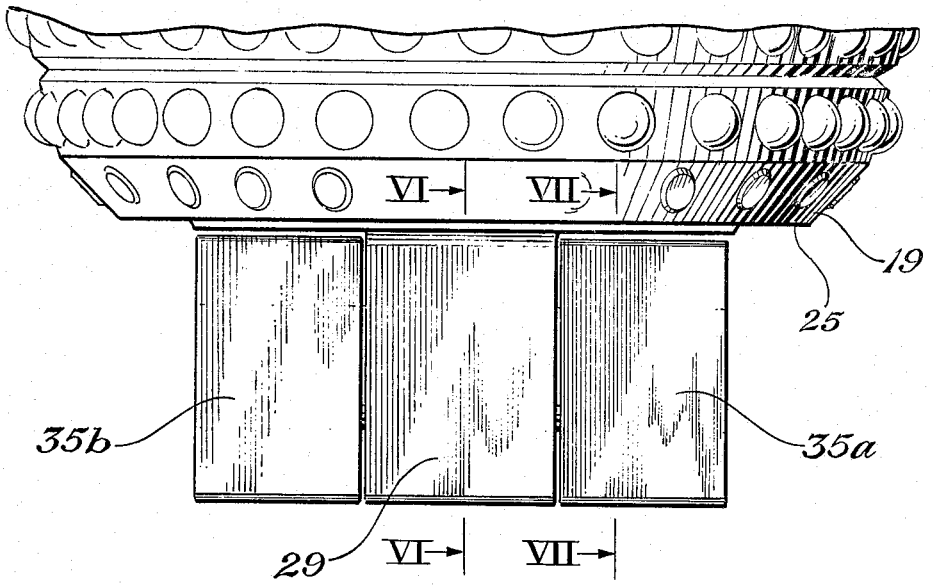
FIG. 5 is a top elevational view of one of the cutter assemblies of FIG. 1.

Referring to FIGS. 2 and 4, wedge means including wedge members 51, 53 are adapted for insertion into the noninterrupted passage. Each wedge member 51, 53 is formed from a cylindrical pipe, truncated at an angle $\beta$ in the range from 5° to 10°, preferably 7° with respect to the longitudinal axis of the cylinder. This defines locking tapered surfaces 55 that mate with each other. An axial passage 57 extends through the outer or cylindrical end 58 of wedge member 53 for the insertion of a bolt 59. A cylindrical threaded nut 61 is adapted to be placed at the end of wedge member 51 for receiving the threaded end of bolt 59. Threaded nut 61 has a lip 63 extending across a portion of the surface that contacts wedge member 51 to prevent rotation when the bolt 59 is rotated. A flattened area 65 is formed on each wedge member 51, 53, commencing at the thickest portion of the taper and extending approximately one half the length of the tapered surface 55. The flattened areas 65 are located on each side of each wedge member to prevent interference with the elliptical passage. The remaining areas of the wedge members 51, 53 opposite the tapered surface 51 are arcuate. The lengths of wedge members 51, 53 are selected so that when fully assembled and drawn together in the noninterrupted passage under maximum torque, the inner ends 67, 69 will not contact threaded nut 61 nor cylindrical end 58. The thickest portion of the tapered surface 55 is approximately two thirds of the diameter of the apertures 39, 41, while the thinnest part is approximately one third. The diameters of threaded nut 61 and cylindrical end 58 are slightly less than the diameters of apertures 39*a* and *b*.

In operation, to assemble a cutter shell 19 and its bearing carrier 27 with frame 31, the bearing carrier 27 is placed between the clevises 35 with the bearing pin 29 between clevis ends 35*a* and *b*, and bearing against bearing surface 37. This is the position shown in FIG. 3. Then the wedge members 51, 53 are inserted from each side into apertures 39*a,b*, with their inner ends 67, 69 pointed toward each other. The wedge members 51, 53 can be inserted through the noninterrupted passage only when oriented 45°, but either can be inverted so that their arcuate surface faces either away from or toward stem 13.

Figure 6:
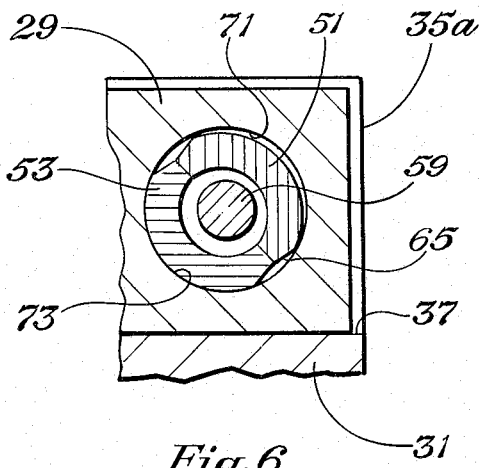
FIG. 6 is a partial cross-sectional view of the cutter assembly of FIG. 5 taken along the line VI—VI.
Figure 7:
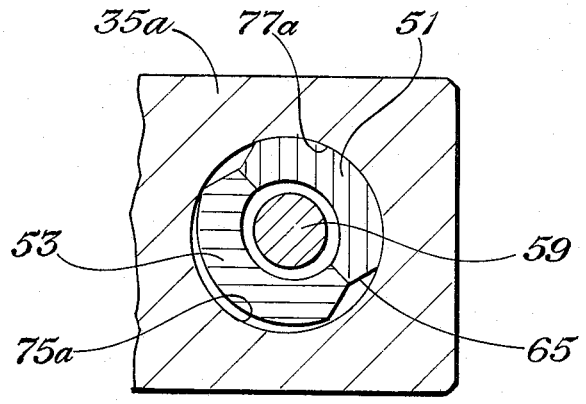
FIG. 7 is a partial cross-sectional view of the cutter assembly of FIG. 5 taken along the lines VII—VII.
Figure 8:
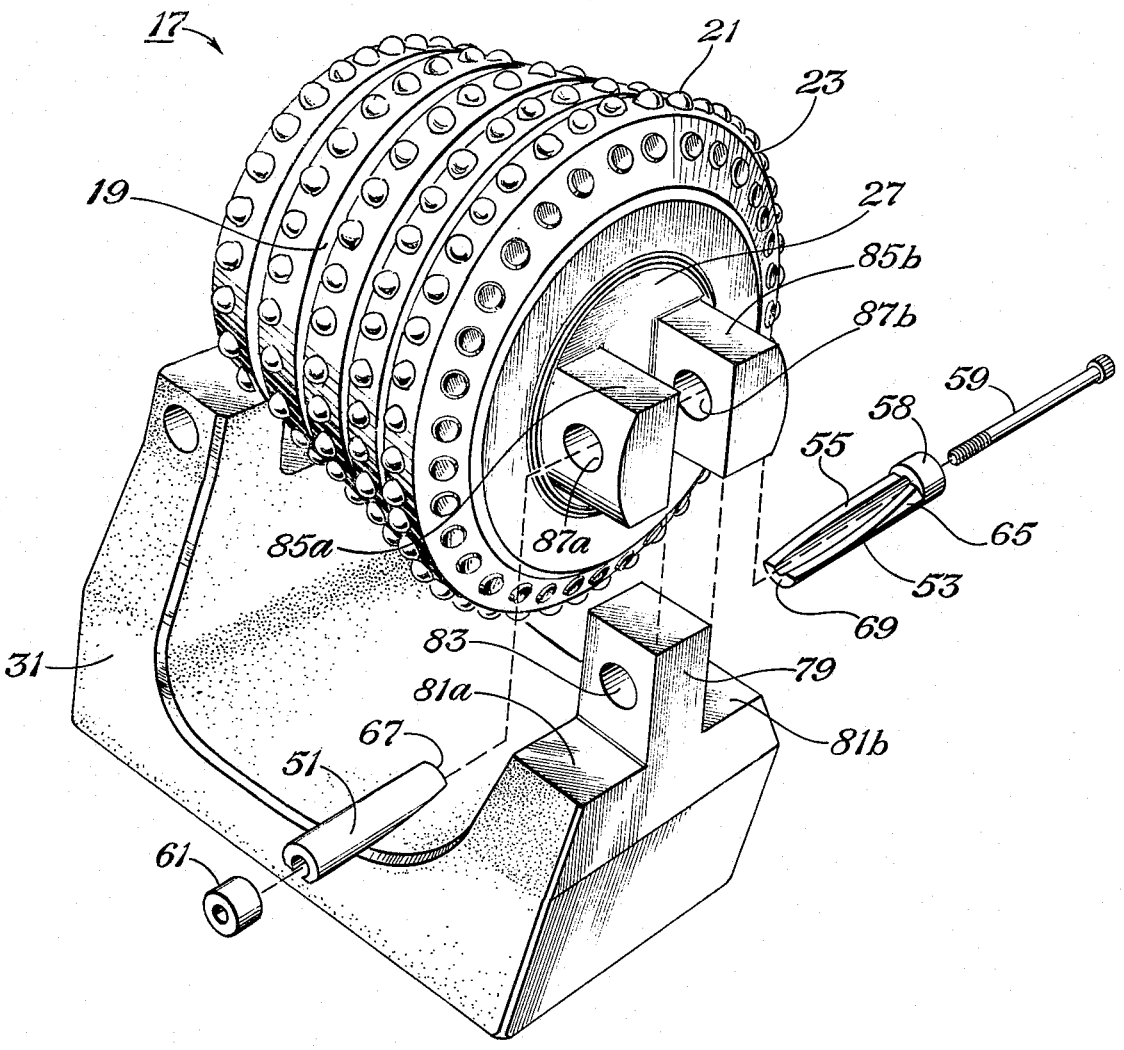
FIG. 8 is an exploded partial perspective view of an alternate embodiment of a cutter assembly constructed in accordance with this invention.

Bolt 59 is inserted and tightened against nut 61 to draw the members 51, 53 together, expanding their thickness or height as the tapered surfaces 55 slide upon each other. When fully tightened as shown in FIGS. 4, 6 and 7, a clearance, indicated as 71, exists between wedge 51 and aperture 43 in the pin block 29. As shown in FIG. 6, clearance 71 is only on the side generally facing stem 13, while the opposite wedge member 53 bears against aperture 43 on the side generally facing away from stem 13, designated as 73. Similarly clearances 75*a,b* between wedge 53 and apertures 39*a,b* exist on the side facing away from the stem 13, while wedge 51 contacts the side facing generally toward stem 13, designated as 77*a,b*. As the wedge members 51, 53 expand, force is exerted between contacting points 73 and 77*a,b*, tending to force the aperture 43 into alignment with apertures 39*a,b*; however this is resisted by bearing surface 37 and inner face 48. To disassemble, the bolt is unscrewed, and since the wedge members form a locking taper, they must be driven out. The cutter and bearing carrier are then lifted free of the frame. An alternate embodiment is disclosed in FIG. 8. In this embodiment, the clevis end is formed on the bearing carrier rather than on the frame, with the remaining structure, wedge means, and principle being the same as the preferred embodiment. A single rectangular block 79 is formed on the frame 31 on each side of the cutter assembly 17. Shoulders 81*a* and 81*b* are formed on each side of block 79. An aperture 83 is formed through block 79. A clevis having two spaced apart ends or blocks 85*a,b* is formed on each end of the bearing carrier 27.

Each block 85*a,b* has an aperture 87*a,b* with coinciding center lines for receiving the wedge members 51, 53. Aperture 83 is equal in diameter to apertures 87*a,b*, but has its centerline slightly closer to the shoulders 81*a,b* than the centerlines of apertures 87*a,b* when blocks 85*a,b* are bearing against shoulders 81*a,b*. As in the preferred embodiment, preferably the centerline of aperture 83 is also offset 45° in the direction away from the drill stem 13 to preload against drilling forces.

It should be apparent that an invention having significant advantages has been provided. The wedging action between the nonaligned holes, resisted by the bearing surface and inner face, creates a positive fit that is preloaded in the direction outward from stem 13. Consequently the force exerted by drilling that tends to push the cutters toward their larger or outer ends, must overcome the preload force before any play will result. Because the clevis coupling relies on nonalignment rather than alignment, fine tolerances are not required. The tapered surfaces give a mechanical advantage so that the bolt does not have to be tightened to a high degree. The assembly and disassembly is quick and requires no special tools.

While the invention has been shown in only one of its forms, it should be apparent to those skilled in the art that it is not so limited but is susceptible to various changes and modifications without departing from the spirit thereof. For example the clevis end could be formed on the bearing carrier rather than the frame.

I claim:

1. In an earth boring drill bit of the type having at least one cutter shell mounted to a bearing carrier that is carried by a frame, an improved means for mounting the bearing carrier to the frame comprising:

a first member formed selectively on one of the frame and the bearing carrier and having two spaced apart ends with apertures on each end axially aligned with each other;

a second member formed selectively on the other of the frame and the bearing carrier, having an end for insertion between the ends of the first member and an aperture that is spaced out of alignment with the apertures of the first member a selected distance;

means for maintaining the aperture of the second member in nonalignment with apertures of the first member; and wedge means, adapted for insertion through the apertures of the first and second members, for tending to draw the aperture of the second member into alignment with the apertures of the first member, the force exerted being transmitted to the means for maintaining the apertures in nonalignment to create a positive fit.

2. In an earth boring drill bit of the type having at least one cutter shell mounted to a bearing carrier that is carried by a frame, an improved means for mounting the bearing carrier to the frame comprising:

a first generally U-shaped member with apertures in the ends and a bearing surface, formed selectively on one of the frame and the bearing carrier;

a second member, having an end with an aperture, adapted for insertion between the ends of the first member and having a surface for bearing against the bearing surface; the second member being formed selectively on the other of the frame and the bearing carrier;

the apertures of the first member being aligned with each other but spaced a different distance from the bearing surface than the apertures of the second member; and wedge means, adapted for insertion through the apertures of the first and second member, for wedging between the portions of the apertures of the first member and second members that are closest to each other, whereby force is exerted by the wedging members against the bearing surface to create a rigid connection between the bearing carrier and the frame.

3. In an earth boring drill bit of the type having a stem with connection means for attachment to a drill pipe, a cutter support means extending laterally from the stem for supporting a plurality of cutter means, the cutter means including a rotatable cutter shell being carried on a bearing carrier and a frame mounted to the cutter support means for carrying the bearing carrier, an improved means for mounting the bearing carrier to the frame comprising:

a first generally U-shaped member formed on the frame with circular apertures in the ends and a bearing surface between the ends;

a second member formed on the bearing carrier, having an end with a circular aperture, the end of the second member being adapted for insertion between the ends of the first member;

the apertures of the first member having a common centerline, but spaced from the aperture of the second member a selected distance so that their centerline is closer to the bearing surface and farther outward from the stem than the centerline of the second member, thus providing a noncircular passage when assembled;

a pair of wedge members adapted for insertion in the noncircular passage, each wedge member having a tapered surface that mates with the opposite wedge member and an arcuate portion opposite the tapered surface to define a generally elliptical cross-section that increases in height as the wedge members are drawn together and the tapered surfaces slide upon each other; and a threaded bolt connected between the wedge members for drawing the wedge members together.

4. The drill bit according to claim 3 wherein the centerline of the first member apertures intersects a line extending from the centerline of the aperture of the second member at an angle that is the range from 15° to 55° negative with respect to the axis of the bearing carrier.

5. The drill bit according to claim 3 wherein the distance that the centerline of the apertures of the first member is spaced from the centerline of the aperture of the second member is in the range from 0.030 inches to 0.060 inches.

6. The drill bit according to claim 3 wherein each wedge member is a hollow cylinder truncated at an angle in the range from 5° to 10° with respect to the axis of the cylinder.

* * * * *